US006824021B2

(12) United States Patent
Masuzzo et al.

(10) Patent No.: US 6,824,021 B2
(45) Date of Patent: Nov. 30, 2004

(54) ACTUATING HEAD OF A DOUBLE-ACTING PUMP FOR EJECTING A PRODUCT FROM A CONTAINER

(75) Inventors: Ettore Masuzzo, Eppstein (DE); Stefan Christ, Hochheim (DE)

(73) Assignee: Aero Pump GmbH, Zerstäuberpumpen, Hochheim/Main (DE)

( * ) Notice: Subject to any disclaimer, the term of this patent is extended or adjusted under 35 U.S.C. 154(b) by 18 days.

(21) Appl. No.: 10/340,873

(22) Filed: Jan. 10, 2003

(65) Prior Publication Data

US 2003/0164385 A1 Sep. 4, 2003

(30) Foreign Application Priority Data

Jan. 10, 2002 (DE) ..... 102 00 593

(51) Int. Cl.[7] ..... B67D 5/40
(52) U.S. Cl. ..... 222/321.7; 222/380; 222/494
(58) Field of Search ..... 222/321.1, 321.7, 222/321.9, 380, 383.1, 494; 239/333

(56) References Cited

U.S. PATENT DOCUMENTS

| | | | | |
|---|---|---|---|---|
| 4,558,821 A | | 12/1985 | Tada et al. | 239/333 |
| 5,024,355 A | | 6/1991 | Jouillat et al. | 222/162 |
| 5,181,658 A | | 1/1993 | Behar | 239/493 |
| 5,186,368 A | | 2/1993 | Garcia | 222/490 |
| 5,207,659 A | * | 5/1993 | Pennaneac'h et al. | 604/298 |
| 5,273,191 A | | 12/1993 | Meshberg | 222/105 |
| 5,558,258 A | * | 9/1996 | Albini et al. | 222/496 |
| 5,769,325 A | | 6/1998 | Jouillat et al. | 239/337 |
| 6,095,376 A | | 8/2000 | Hennemann et al. | 222/190 |
| 6,412,659 B1 | * | 7/2002 | Kneer | 222/82 |
| 6,443,370 B1 | * | 9/2002 | Brulle et al. | 239/333 |

FOREIGN PATENT DOCUMENTS

| | | |
|---|---|---|
| DE | 201 035144 U1 | 6/2001 |
| EP | 0 032 541 A2 | 7/1982 |
| EP | 0864371 | 9/1998 |
| FR | 2 622 478 A1 | 5/1989 |
| FR | 2 635 084 A1 | 2/1990 |
| GB | 917135 A | 4/1963 |
| GB | 1 586 170 A | 3/1981 |
| NL | 6918423 | 12/1969 |
| WO | 9967025 | 12/1999 |

* cited by examiner

*Primary Examiner*—Joseph A. Kaufman
(74) *Attorney, Agent, or Firm*—Friedrich Kueffner

(57) ABSTRACT

An actuating head (12) of a double-acting pump (1) for ejecting a product (38) from a container (2) includes an outlet duct (13*a*–13*d*) leading to an ejection opening (16), wherein a closing piece (18) biased by a spring (17) is arranged in the outlet duct. The closing piece (18) directly seals the ejection opening (16) under the force of the spring (17) and the closing piece (18) releases as a result of the pressure exerted when actuating the double-acting pump (1) the flow of the product (38) through the outlet duct (13*a*–13*d*) and through the ejection opening (16) against the force of the spring (17). For simplifying the construction and for avoiding the danger of contamination of the product, it is ensured according to the present invention that a first outlet duct section (13*d*) following the ejection opening (16) is surrounded by a tube (15) in which the closing piece (18) is sealingly slideably guided and which is inserted in a bore (14) in the body of the actuating head (12), wherein the bore (14) defines between itself and the tube (15) an annular space forming a second outlet duct section (13*b*), wherein the annular space is connected through a third outlet duct section (13*c*) traversing the wall of the tube (15) to the first outlet duct section (13*d*).

7 Claims, 5 Drawing Sheets

ACTUATING HEAD OF A DOUBLE-ACTING PUMP FOR EJECTING A PRODUCT FROM A CONTAINER

BACKGROUND OF THE INVENTION

1. Field of the Invention

The invention relates to an actuating head of a double-acting pump for ejecting a product from a container, wherein the container has an outlet duct leading to an ejection opening and a closing piece biased by a spring is arranged in the outlet duct, wherein the closing piece in a closed position thereof directly seals the ejection opening under the force of the spring, and wherein the pressure of the product exerted when the double-acting pump is actuated releases the flow of the product through the outlet duct and through the ejection opening against the force of the spring.

2. Description of the Related Art

In a known actuating head of this type (DE 201 03 144 U1), an outlet duct section extends through the body of the actuating head up to a cylindrical space in a bore of the body which follows the outlet opening and in which the closing piece is sealingly guided. The construction of this outlet duct section is cumbersome. It requires a complicated molding tool if the body of the actuating head, as is usual, is manufactured of thermoplastic material. In addition, the outlet duct section must be constructed of two parts, wherein the two parts must be tightly connected to each other, either by welding or gluing, which is time-consuming and labor-intensive.

In another known actuating head (DE 27 09 796 B2), the closing piece is constructed as a valve slide which is slideable transversely of an inlet opening of on outlet duct located between the closing piece and the ejection opening. Arranged in the outlet duct in front of the ejection opening is a turbulence chamber. Through the ejection opening the outlet duct is in connection with the outside in any position of the closing piece. Accordingly, any product rest which has not been completely ejected from the outlet duct can come into contact with contaminating and harmful germs, bacteria or viruses contained in the ambient air and with aggressive gases which are harmful for the product, particularly ambient oxygen. Such harmful influences are especially undesirable or dangerous if the product is a foodstuff, a medicament, deodorant or another product which is taken in or picked up by a person, even if only a small contaminated product rest remains in the actuating head. During the next actuation after a long period of no actuation, such a contaminated product rest could be ejected together with the product and could endanger the health of the user.

It is the object of the invention to provide an actuating head of the above-described type which is simple to manufacture and in which the danger of a contamination of the product is essentially prevented.

In accordance with the invention, this object is met in an actuating head of the above-described type in that a first outlet duct section following the ejection opening is surrounded by a tube in which the closing piece is sealingly slideably guided and which is inserted into a bore in the body of the actuating head, wherein the bore defines between itself and the tube an annular space which forms a second outlet duct section, wherein the second outlet duct section is connected through a third outlet section traversing the wall of the pipe to the first outlet duct section.

SUMMARY OF THE INVENTION

In this solution, the three above-mentioned outlet duct sections are defined by the bore and the tube, wherein the tube only has to be inserted tightly into the bore. Accordingly, shaping of the actuating head is very simple, independently of its material which preferably is thermoplastic material. In addition, a product rest present in the outlet duct cannot be contaminated either in the open position or in the closed position of the closing piece: in the open position which lasts only a short time during the product ejection, the product rest would be substantially ejected, and in the closed position the outlet duct is completely blocked to the outside by the closing piece. Consequently, a product rest remaining in the outlet duct cannot come into contact with harmful germs, bacteria, viruses, etc. and with harmful materials, such as gases, particularly ambient oxygen.

It is preferably ensured that the closing piece includes a piston which seals the closing piece relative to the inner side of the outlet duct, wherein the piston has a piston rod which in the closed position of the closing piece projects with an end portion thereof tightly in the ejection opening. The closing piece not only acts as a closing piece, but also as a pressure piston which, after the actuation of the double-acting pump by the actuating head, ejects the product remaining in the outlet duct under the force of the spring through the ejection opening and simultaneously blocks the ejection opening.

Moreover, the portion of the piston rod adjacent the end portion may have a greater diameter than the ejection opening and, in the closed position of the closing piece, rests against the inner edge of the ejection opening under the force of the spring. The portion of the piston rod having the greater diameter additionally comes into sealing contact with the inner edge of the ejection opening during the closing movement of the closing piece under the force of the spring with its shoulder surface extending from the larger to the smaller diameter. Simultaneously, the closing movement is limited.

The piston preferably has a circumferential sealing lip which permits passage of the product only in the direction toward the ejection opening. On the one hand, the sealing lip facilitates the passage of air from the spring chamber into the outlet duct during the first actuation of the actuating head, so that the product pressure essentially only has to overcome the spring force during the product ejection. The air which penetrated from the spring chamber into the outlet duct would during the first actuation be partially mixed with the product quantity which has been ejected and which will be ejected during the next actuation. However, during the second and all following actuations, no additional air would penetrate from the spring chamber into the outlet duct because the excess pressure of the air has already been eliminated and the sealing lip permits only the air passage in one direction and, thus, no renewed penetration of air into the spring chamber. In the same manner, penetration of the product through the sealing lip into the spring chamber is prevented.

The sealing lip may particularly be constructed as a cup-shaped material. The cup-shaped material is additionally pressed by the product pressure against the inner side of the outlet duct and, thus, ensures a particularly high sealing effect.

The closing piece is preferably of a rubber-elastic material with an excess dimension of the end portion relative to the diameter of the ejection opening. As a result of this configuration, the end portion of the piston rod rests particularly tightly in the ejection opening in the closed position of the closing piece. This results in a particularly high sealing effect of the end portion in the ejection opening.

The rubber-elastic material may be a plastic material. Such a material facilitates a simple construction of the closing piece as a single piece.

BRIEF DESCRIPTION OF THE DRAWINGS

The invention and its further developments will be described below in more detail with the aid of the enclosed drawings showing a preferred embodiment. In the drawing.

DETAILED DESCRIPTION OF THE PREFERED EMBODIMENTS

Figure 1:
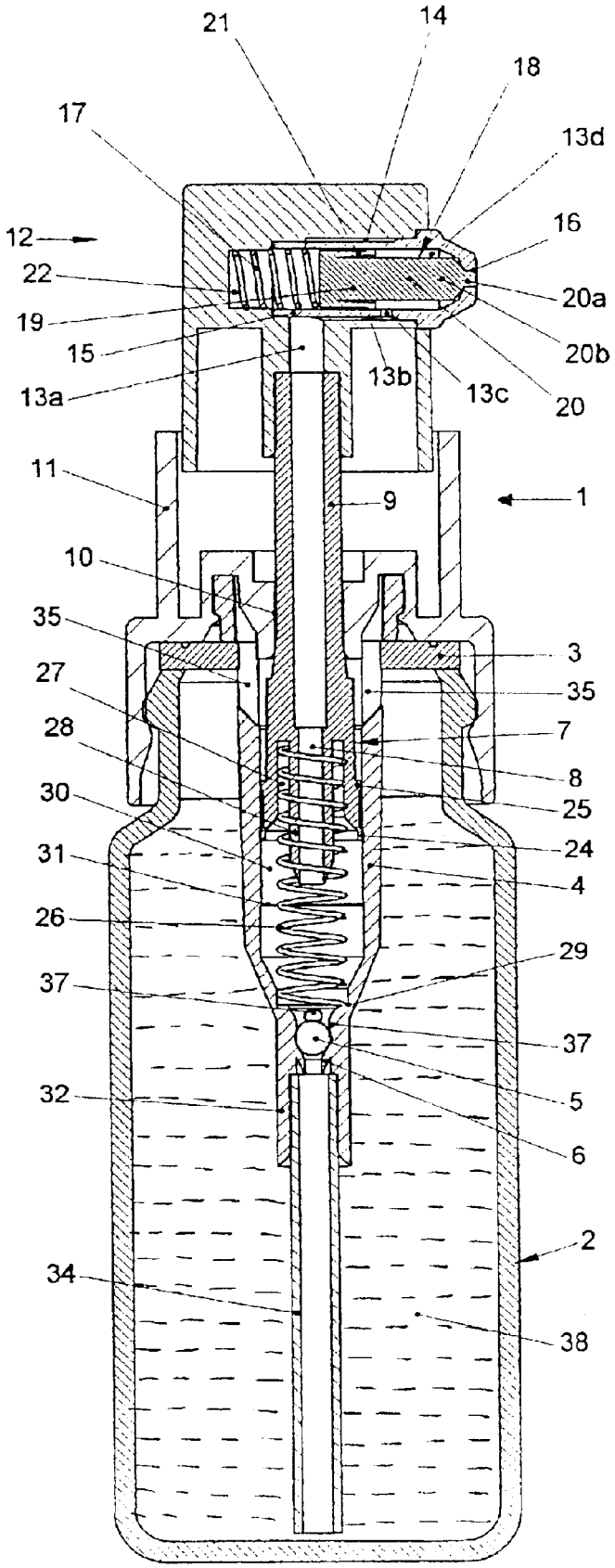
FIG. 1 is an axial sectional view of a double-acting pump with an actuating head according to the present invention on a container filled with product to be ejected, shown prior to the first actuation of the double-acting pump by means of the actuating head.

The double-acting pump 1 shown in the drawing is tightly fastened on the rim of the opening of a container 2 through a sealing ring disc 3 arranged between the pump and the container. The double-acting pump 1 includes a hollow-cylindrical housing 4. The lower end of the housing 4 can be blocked off by a check valve with a valve closing ball 5. In its lower position illustrated in FIG. 1, the valve closing ball 5 is tightly seated on a valve seat 6.

Arranged in the housing 4 is a hollow-cylindrical piston 7 so as to be axially slideable and sealed against the inner side of the housing 4. The bore 8 of the piston 7 extends as a hollow piston rod 9 integrally formed on the piston 7. The piston rod 9 is slideable in an opening 10 of an upper closing hood 11 so as to be sealed relative the housing 4 and container 2.

An actuating head 12 of the double-acting pump 1 is sealingly and tightly placed on the free end of the piston rod 9 which protrudes out of the housing 4. An outlet duct, composed of outlet duct sections 13*a*–13*d*, extends through the actuating head 12, wherein the outlet duct is connected to the bore 8. The outlet duct section 13*b* is constructed as an annular space which is defined by the inner side of a bore 14 in the body of the actuating head 12 and the outer side of a tube 15 which is tightly placed in the bore 14. The outlet duct section 13*c* is a bore extending through the wall of the tube 15, wherein the bore opens into the outlet duct section 13*d* which forms the inner space of the tube 15. The diameter of the tube 15 becomes smaller toward its outer end with an ejection opening 16. Axially slideably arranged in the outlet duct section 13*d* is a closing piece 18 which is biased by a weak spring 17. The closing piece 18 has a piston 19 which seals against the inner side of the outlet duct section 13*d* in the tube 15, wherein the piston 19 has a piston rod 20 which, in the closed position of the closing piece 18 shown in FIG. 1, projects with an end portion 20*a* tightly in the ejection opening 16. The portion 20*b* of the piston rod 20 adjacent the end portion 20*a* has a greater diameter than the outlet opening 16 and in the closed position of the closing piece 18 rests with an inclined transition from the larger to the smaller diameter against the inner rim of the ejection opening 16 under the force of the spring 17. The piston 19 has a circumferential sealing lip 21 which tightly rests as a result of its own elasticity against the inner side of the tube 15 or the outlet duct section 13*d* and which permits passage of a medium only in the direction toward the ejection opening 16, while blocking the chamber 22 which contains the spring 17. The sealing lip 21 is formed by a cup-shaped material. The closing piece 18 is of a rubber-elastic material, particularly an elastomer material, with an excess dimension of the end portion 20*a* of the piston rod 20 relative to the diameter of the ejection opening 16.

Figure 3:
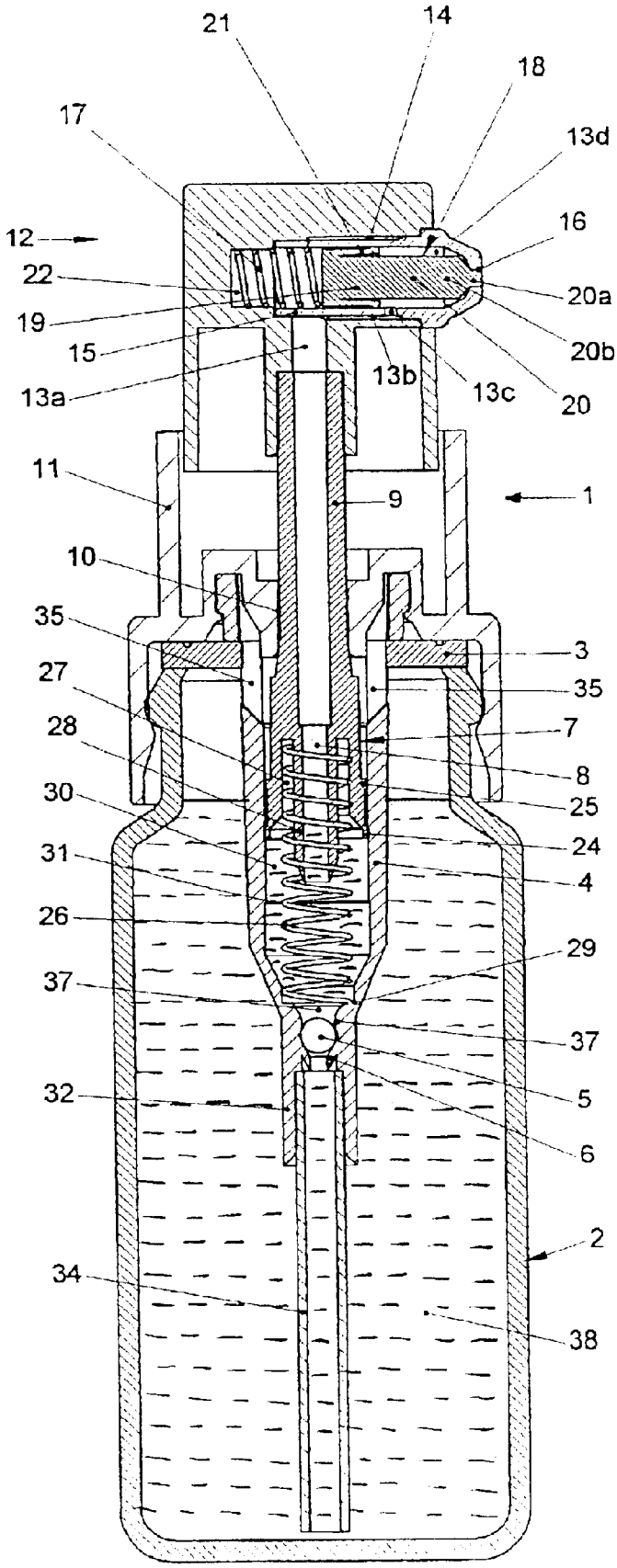
FIG. 3 is an axial sectional view of the double-acting pump and the container of FIG. 1, shown at the end of the first suction movement of the double-acting pump.
Figure 5:
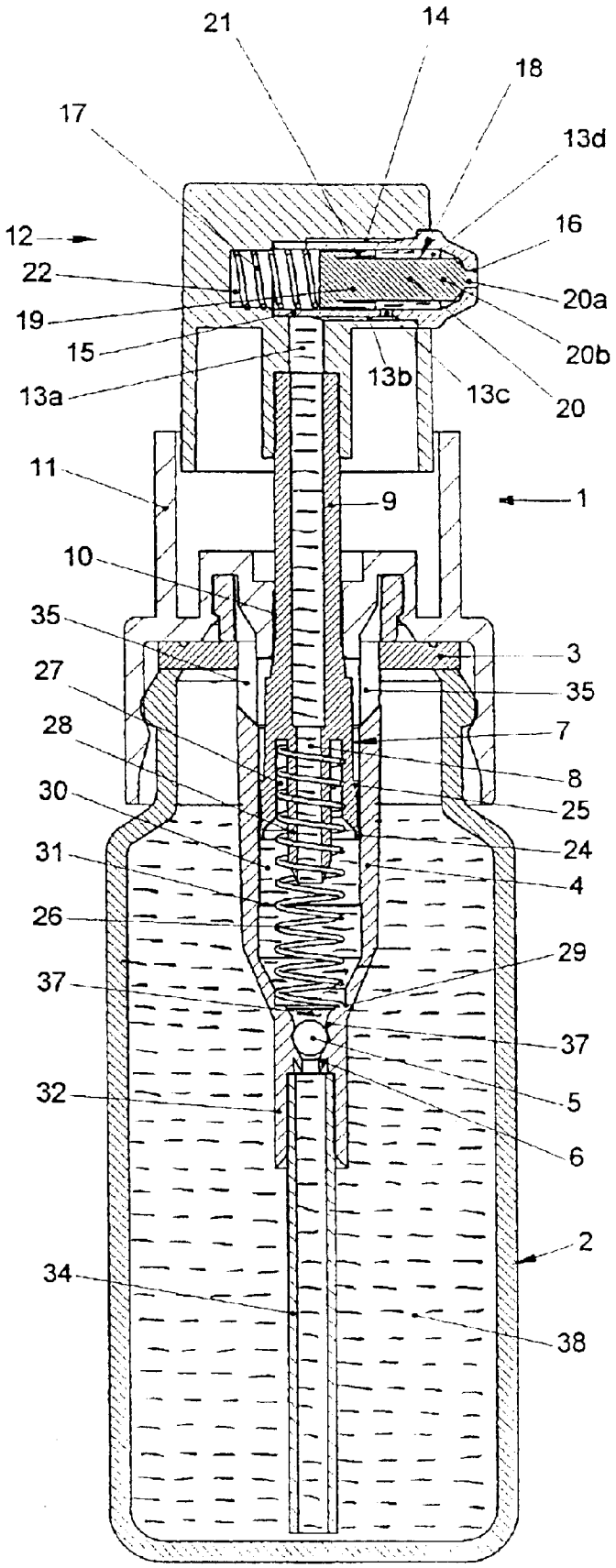
FIG. 5 is an axial sectional view of the double-acting pump in the same position as in FIG. 1, however, at the end of an ejection actuation.

In its non-actuated position according to FIGS. 1, 3 and 5, the piston 7 rests with a sealing lip 24 arranged circumferentially at its free end tightly against the inner side of the housing 4. A collar 25 surrounding the piston 7 above the sealing lip 24 serves for guiding the piston 7 during its movement, however, a play remains between the collar 25 and the inner side of the housing 4. A restoring spring 26, shown in broken lines, rests in the piston 7 against the bottom of an annular space 27 which is defined by the outer wall of the piston 7 and a tube piece 28, on the one hand, and against a shoulder 29 in the housing 4, on the other hand. The housing has at the end of a pressure space 30 defined by the housing 4 a step 31 underneath of which the inner diameter of the housing 4 is somewhat greater than the outer diameter of the sealing lip 24 of the piston 7. An immersion tube 34 protruding close to the bottom of the container 2 is fastened in a connecting piece 32 at the free lower end of the housing 4. Above the upper end position of the piston 7 according to FIG. 1, the housing 4 is connected through lateral slots 35 to the inner space of the container 2 above the maximum product level.

Figure 2:
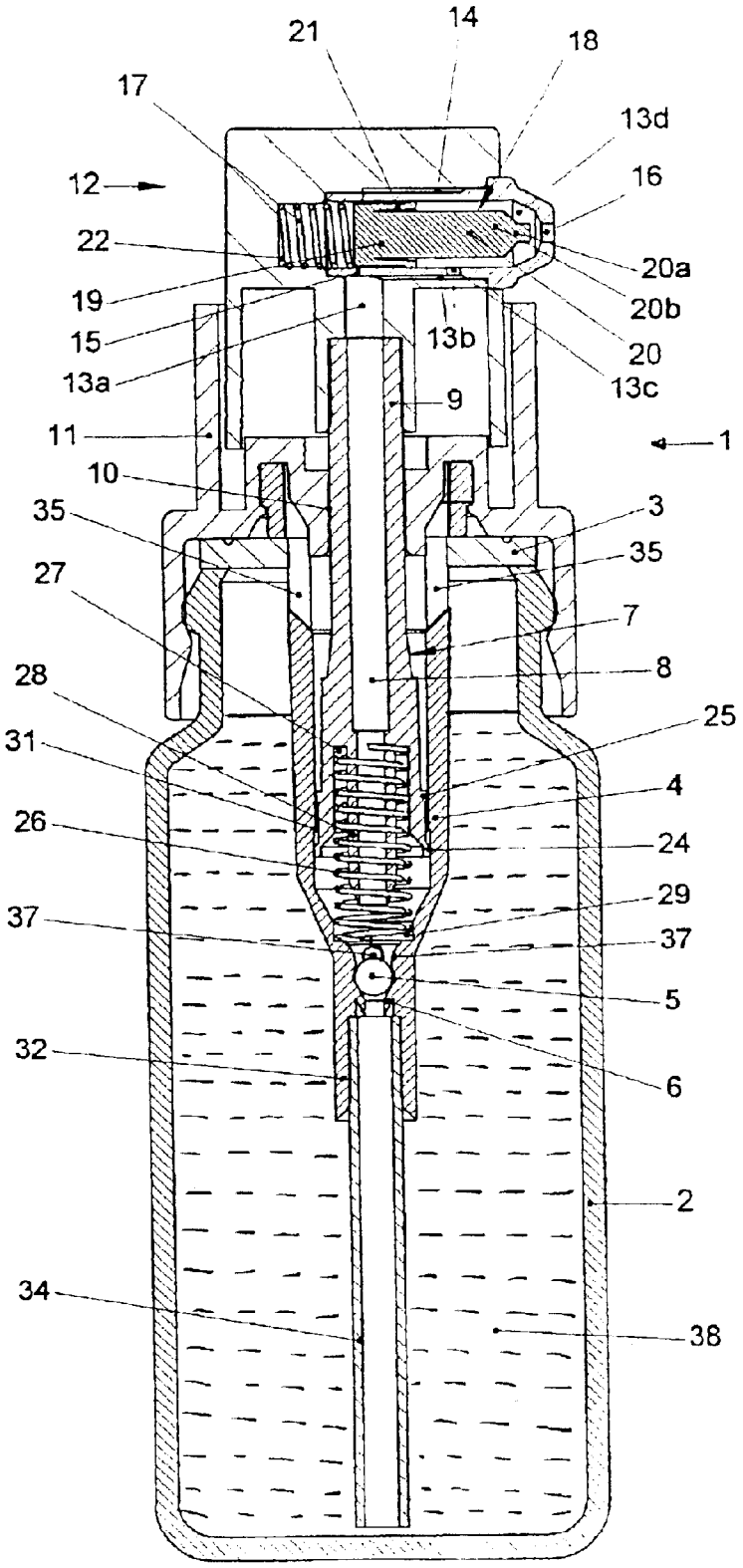
FIG. 2 is an axial sectional view of the double-acting pump and the container of FIG. 1, shown during a first actuation of the double-acting pump by means of the actuating head.

During the first actuation of the actuating head 12 by manually exerting a pressure on its upper side, the piston 7 moves against the force of the restoring spring 26 in the space 30 according to FIG. 2 in the direction toward the check valve 5, 6. The resulting pressure in the space 30, in the bore 8 and in the outlet duct 13*a*–13*d* causes the check valve 5, 6 to be kept closed, on the one hand, and the sealing lip 21 of the closing piece 18 is pressed against the inner side of the tube 15 or the outlet duct section 13*d* defined by the tube 15, on the other hand. Consequently, the piston 19 is displaced against the force of the spring 17 and the end portion 20*a* of the piston rod 20 is pulled out of the ejection opening 16. In this situation, the air contained in the space 30, in the bore 18, in the outlet duct 13*a*–13*d* and in the spring chamber 22 can escape only partially through the ejection opening 16. After the manual pressure has been removed from the actuating head 12, the restoring spring 26 presses the piston 7 and the spring 17 presses the piston 19 back into the position illustrated in FIG. 3. The resulting negative pressure in the space 30, in the bore 8 and in the outlet duct 13*a*–13*d* causes the valve closing ball 5 to be lifted off from its seat 6 up to against the ribs 37 formed above the ball 5 in the housing 4. Simultaneously, the negative pressure causes a portion of the product 38 contained in the container 2 to be withdrawn from the container 2 through the immersion tube 34 and the open check valve 5, 6 into the space 30, as illustrated in FIG. 3. The product 38 is preferably paste-like, but can also be a liquid.

When the piston 7 is once again pushed down by means of the actuating head 12, the check valve 5, 6 is once again closed and the piston 19 is pushed once again against the force of the spring 17 into the position shown in FIG. 2.

Figure 4:
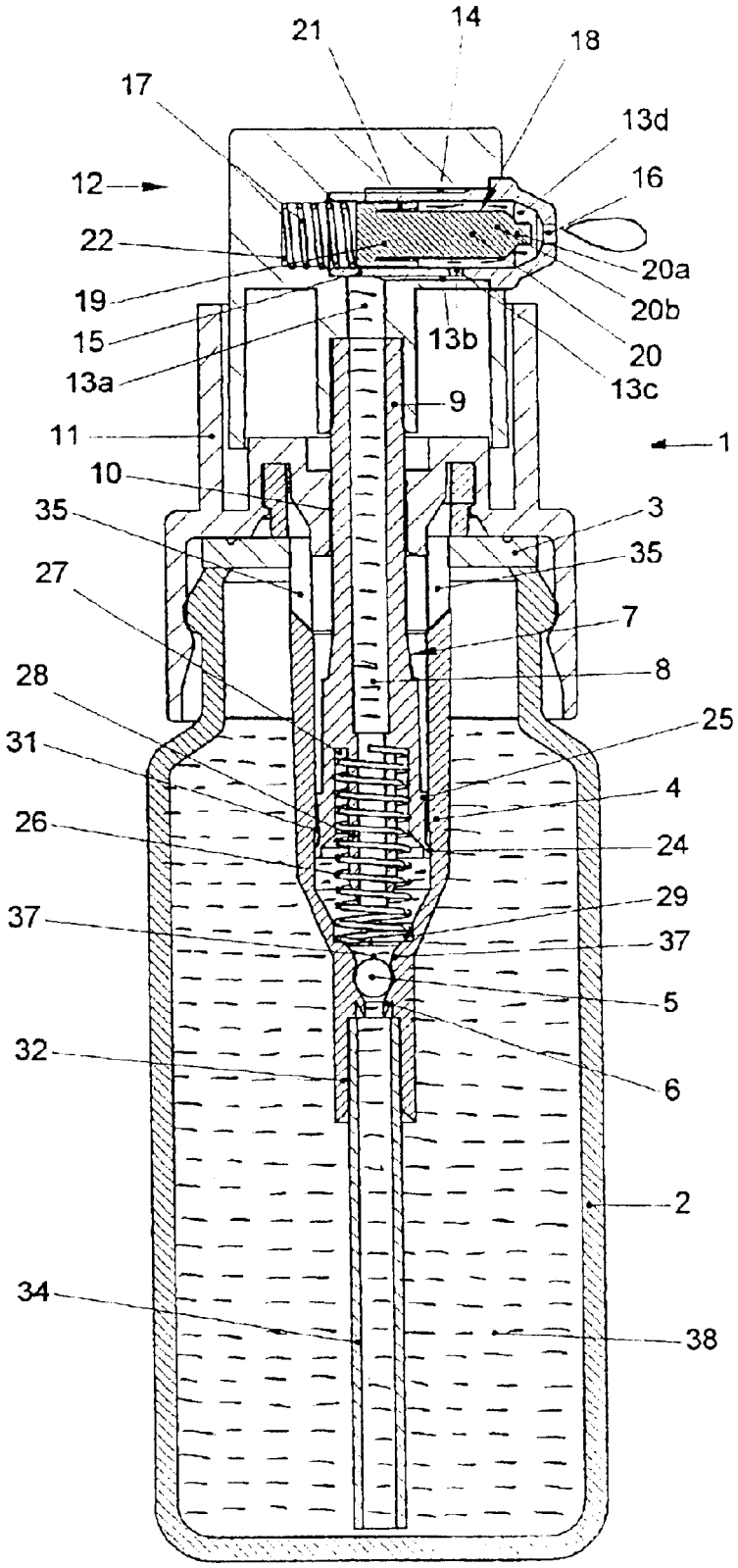
FIG. 4 is the same axial sectional view as FIG. 2, shown during a first ejection actuation.

Simultaneously, the product is ejected out of the space 30 through the bore 8, the outlet duct 13*a*–13*d* and the ejection opening 16 which is once again open, as illustrated in FIG. 4. The piston 7 can be pressed with its sealing lip 24 up to underneath the step 31. As soon as the sealing lip 24 has traveled past the step 31, the pressure in the space 30 is eliminated past the sealing lip 24 and the collar 25 of the piston 7 and through the slots 35 into the space of the container 2 above the product level, so that no additional product 38 is ejected. As a result, the product quantity ejected during each actuation is precisely metered.

During the return movement of the piston 7 which follows the removal of the manual pressure on the actuating head 12, the piston 7 once again draws a portion of the product 38 from the container 2 into the space 30, wherein the piton 19 once again closes the ejection opening 16 under the pressure of the spring 17, as illustrated in FIG. 5.

When the piston 7 is once again pushed down from the position according to FIG. 5 into the position according to FIG. 4, once again a precisely metered product quantity is immediately ejected. The same occurs during each further actuation until the container 2 is completely empty.

As shown in FIGS. 1, 3 and 5, the outlet duct 13*a*–13*d* is in the closed position of the closing piece 18 completely closed off from the outside by the closing piece 18. Consequently, a product rest remaining in the outlet duct cannot come into contact with harmful germs, bacteria, viruses, etc., and with harmful materials, gases, etc. On the other hand, the open position of the closing piece 18 shown in FIGS. 2 and 4 only lasts a short time. A product rest remaining in the outlet duct 13*a*–13*d* would be mostly ejected during the product ejection and could not be contaminated, because the open position of the closing piece 18 lasts only a short time.

The closing piece 18 not only acts as a closing piece, but also as a pressure piston which, after the actuation of the actuating head 12, ejects any product remaining in the section 13*d* of the outlet duct under the force of the spring 17 and simultaneously blocks off the ejection opening 16. The portion 20*b* of the piston rod 20 having the greater diameter rests during the closing movement of the closing piece 18 under the force of the spring 17 with its shoulder surface extending from the larger to the smaller diameter additionally sealingly against the inner rim of the ejection opening 16. This simultaneously limits the closing movement of the closing piece 18.

On the one hand, the sealing lip 21 facilitates the passage of air from the spring chamber 22 into the outlet duct during the first actuation of the actuating head 12 and, thus, a displacement of the piston 19 against of the force of the spring 17. Therefore, essentially only the force of the spring 17 has to be overcome by the product pressure during the product ejection. During the first actuation, any air which has penetrated from the spring chamber 22 into the outlet duct would be mixed partially with the product quantity which has been ejected and the product quantity to be ejected during the next actuation. However, during the second and any following actuation, no further air would penetrate from the spring chamber 22 into the outlet duct because its excess pressure has already been eliminated and the sealing lip 21 permits the passage of air only in one direction and, thus, no additional penetration of air into the spring chamber 22. In the same manner, a penetration of the product through the sealing lip 21 into the spring chamber 22 is prevented. Since the sealing lip is constructed as a cup-shaped material, the sealing lip is additionally pressed by the product pressure against the inner side of the tube 15 or the section 13*d* of the outlet duct. Accordingly, the sealing lip ensures a particularly high sealing effect. Since the closing piece 18 is of rubber-elastic material and because its end portion 20*a* has an excess dimension relative to the inner diameter of the ejection opening 16, the end portion 20*a* rests in the closed position of the closing piece 18 particularly tightly in the ejection opening 16. This results in a particularly high sealing effect of the end portion 20*a* in the ejection opening 16. Moreover, when the rubber-elastic material of the closing piece 18 is a plastic material, the closing piece 18 can be constructed in a simple manner as a single piece.

What is claimed is:

1. Actuating head (12) of a double-acting pump (1) for ejecting a product (38) from a container (2), wherein the actuating head (12) has an outlet duct (13*a*–13*d*) leading to an ejection opening (16), wherein a closing piece (18) biased by a spring (17) is arranged in the outlet duct, wherein the closing piece (18) in its closed position directly seals off the ejection opening (16) under the force of the spring (17) and wherein the closing piece (18) releases the flow of the product (38) through the outlet duct (13*a*–13*d*) and through the ejection opening (16) as a result of the pressure occurring during actuation of the double-acting pump (1) against the force of the spring (17), wherein a first outlet duct section (13*d*) following the ejection opening (16) is surrounded by a tube (15) in which the closing piece (18) is sealingly slidingly guided and which is placed in a bore (14) in the body of the actuating head (12), wherein the bore (14) defines between itself and the tube (15) an annular space forming a second outlet duct section (13*b*), wherein the annular space is connected to the first outlet duct section (13*d*) through a third outlet duct section (13*c*), which traverses the wall of the tube (15).

2. Actuating head according to claim 1, wherein the closing piece (18) has a piston (19) which seals against the inner side of the outlet duct (13*a*–13*d*), wherein the piston (19) has a piston rod (20) which in the closed position of the closing piece (18) protrudes with an end portion (20*a*) tightly in the ejection opening (16).

3. Actuating head according to claim 2, wherein the portion (20*b*) of the piston rod (20) adjacent the end portion (20*a*) has a greater diameter than the ejection opening (16) and in the closed position of the closing piece (18) the portion (20*b*) rests against the inner rim of the ejection opening (16) under the force of the spring (17).

4. Actuating head according to claim 2 or 3, wherein the piston (19) has a circumferential sealing lip (21) which permits passage of a medium only in the direction toward the ejection opening (16).

5. Actuating head according to claim 4, wherein the sealing lip (21) is formed by a cup-shaped material.

6. Actuating head according to one of claims 1 to 3, wherein the closing piece (18) is of a rubber-elastic material with an excess dimension of the end portion (20*a*) relative to the diameter of the ejection opening (16).

7. Actuating head according to claim 6, wherein the rubber-elastic material is a plastic material.

* * * * *